United States Patent [19]

Dedrich

[11] Patent Number: 5,046,771

[45] Date of Patent: Sep. 10, 1991

[54] DOOR CONTROL ROD ANTI RATTLE SHOE

[75] Inventor: Paul M. Dedrich, Clarkston, Mich.

[73] Assignee: General Motors Corporation, Detroit, Mich.

[21] Appl. No.: 618,147

[22] Filed: Nov. 26, 1990

[51] Int. Cl.[5] ..... E05C 21/00

[52] U.S. Cl. ..... 292/336.3; 292/1; 292/DIG. 38; 292/DIG. 53; 292/DIG. 56

[58] Field of Search ..... 292/336.3, 1, 347, 216, 292/280, DIG. 38, DIG. 53, DIG. 56, DIG. 73, DIG. 57, DIG. 64; 403/71

[56] References Cited

U.S. PATENT DOCUMENTS 3,679,249 7/1972 Hoffmann ..... 403/71 X 4,477,110 10/1981 Smith ..... 292/DIG. 38 X 4,861,081 8/1989 Satoh ..... 292/DIG. 53 X

*Primary Examiner*—Richard E. Moore

*Attorney, Agent, or Firm*—Charles E. Leahy

[57] ABSTRACT

A shoe for slidably and rotatably mounting a door latch control rod on a vehicle door includes a molded plastic body rotatably mounted on the door and having a slot formed therein for receiving the rod. The slot is defined by first and second conical converging walls projecting into the plastic body and intersecting one another to define a C-shaped edge circumjacently engaging the rod in slip fitting rattle free relationship therewith so that the rod may slide through the shoe upon operation of the door control rod by the occupant.

3 Claims, 1 Drawing Sheet

DOOR CONTROL ROD ANTI RATTLE SHOE

The invention relates to a shoe mounting a door lock rod on the vehicle door and more particularly provides conically converging slot walls of the shoe gripping the control rod in anti-rattle slip fit relationship.

BACKGROUND OF THE INVENTION

It is well known in motor vehicle doors to provide a control rod reaching from a control handle to the door latch to control the operation of the latch. For example, such control rods may connect the door handle with the lock in order to unlatch the door latch. In addition such rods may extend from the door lock button to the door latch to lock and unlock the door latch. The mounting of such control rods within a vehicle door can cause rattles and accordingly the prior art has recognized the advantage of rotatably mounting a molded plastic shoe on the door and snap fitting the control rod into the shoe so that the shoe supports the control rod to prevent rattling against the door.

The present invention provides a new and improved anti-rattle shoe for a door lock and particularly provides a shoe which consistently and reliably grips the rod in a manner which permits the rod to slid through the shoe and also prevents the rod from rattling against the shoe.

SUMMARY OF THE INVENTION

According to the invention, a shoe for slidably and rotatably mounting a door latch control rod on a vehicle door includes a molded plastic body rotatably mounted on the door and having a slot formed therein for receiving the rod. The slot is defined by first and second conical converging walls projecting into the plastic body and intersecting one another to define a C-shaped edge circumjacently engaging the rod in slip fitting rattle free relationship therewith so that the rod may slide through the shoe upon operation of the door control rod by the occupant.

Accordingly, the object, feature and advantage of the invention resides in the provision of a molded plastic shoe having a control rod receiving slot which defines a C-shaped edge circumjacently engaging the rod close fitting, rattle free, but slip fitting relationship so that the rod may slide through the shoe and yet is prevented from rattling against the shoe.

BRIEF DESCRIPTION OF THE DRAWINGS

These and other objects, features and advantages of the invention will become apparent upon consideration of the description of the preferred embodiment and the appended drawings in which.

DESCRIPTION OF THE PREFERRED EMBODIMENT

Figure 1:
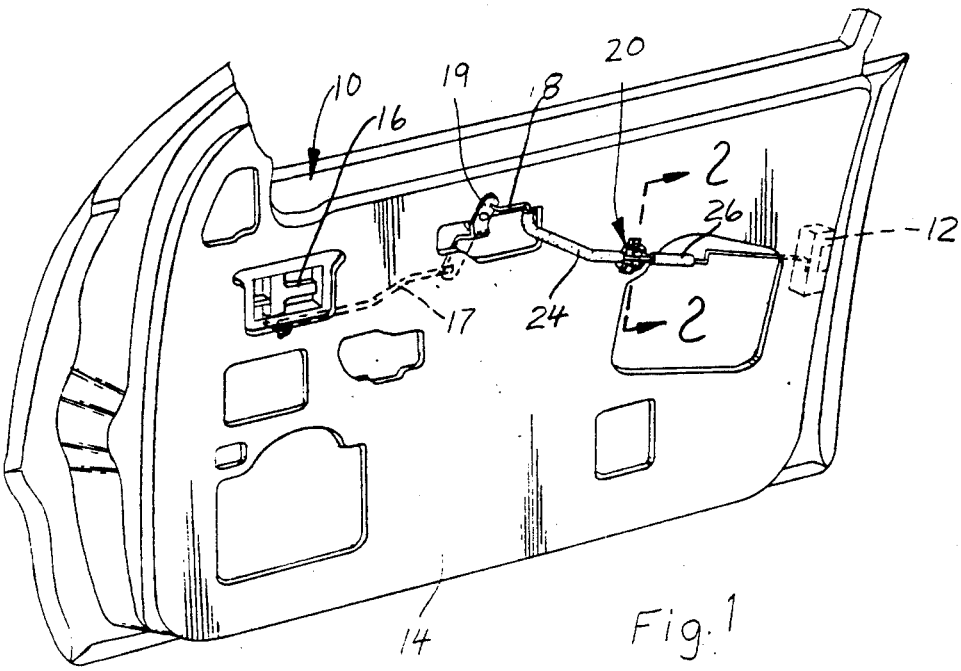
FIG. 1 is a perspective view of a vehicle door having a door latch control rod mounted on the door by a rotatable shoe.

Referring to FIG. 1, the vehicle door 10 carries a door latch 12 which is provided to latch the door 10 in a closed position with respect to the vehicle body. The door latch 12 is a conventional door latch and includes a locking feature by which the door latch can be locked. The door 10 also has a door inner panel 14 which pivotally mounts a door handle 16. The door handle 16 is connected to the door latch 12 by a control rod 17, crank 19 and control rod 18 so that actuation of the door handle 16 shifts the control rod 18 longitudinally and operates the door latch 12.

In order to prevent the control rod 18 from rattling against the door inner panel 14, the control rod is supported at mid-length by a shoe 20. In addition, a sleeve 24 and 26 is carried by the control rod 18.

Figure 2:
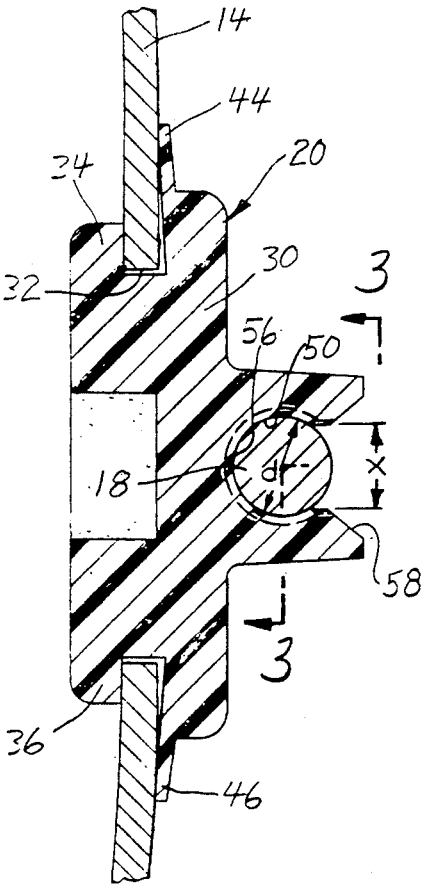
FIG. 2 is a sectional view through the shoe taken in the direction of arrows 2—2 of FIG. 1.
Figure 3:
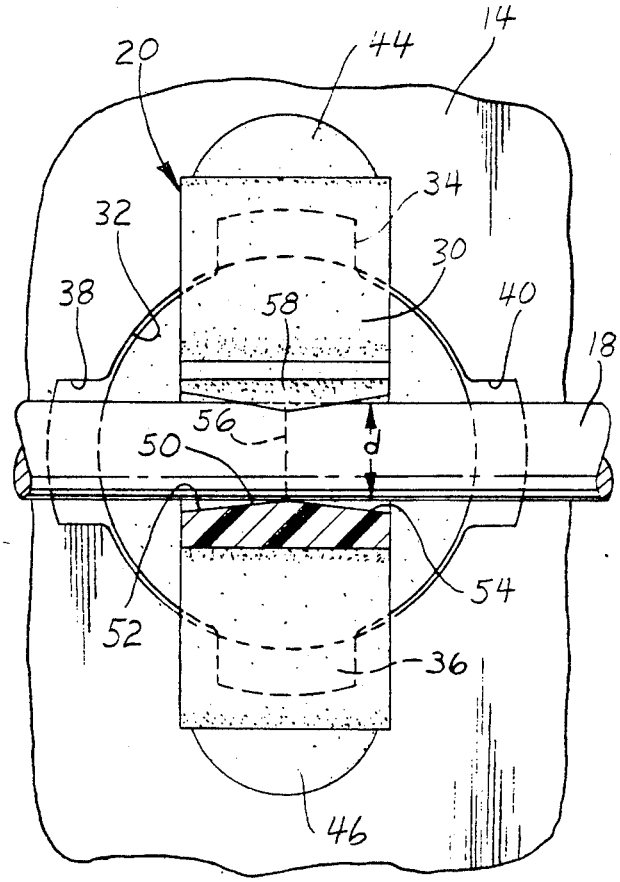
FIG. 3 is a view taken in the direction of arrows 3—3 of FIG. 2 and having parts broken away and in section.

Referring to FIGS. 2 and 3, it is seen that the shoe 20 is constructed of molded plastic and includes a body 30 which is adapted for insertion through an aperture 32 provided in the door inner panel 14. The portion of the body 30 which extends through the aperture 32 carries a pair of diametrically opposed mounting feet 34 and 36 which are inserted through extensions 38 and 40 of the aperture 32. Accordingly, when the body 30 is rotated 90 degrees to the position of FIGS. 2 and 3, the feet 34 and 36 underlie the panel 14 to effectively mount the shoe 20 on the inner panel 14 and yet permit rotation of the shoe 20. Furthermore, as best seen in FIGS. 2 and 3, the body carries flexible feet 44 and 46 which bear upon the panel 14 and urge the legs 34 and 36 into engagement with the panel 14 so that the shoe 20 is retained against rattling with respect to the door inner panel 14.

The shoe 20 has a slot 50 formed therein for snap-fit receiving of the control rod 18. The slot 50, as best seen in FIG. 3, is defined by a first conical converging wall 52 and a second conical converging wall 54 which intersect one another at the mid point of the shoe 20, as viewed in FIG. 3, to define a C-shaped edge 56 which circumjacently engages the control rod 18 in a slip fitting, rattle free relationship therewith. The open side entry portion 58 of the slot 50 permits the control rod to be snap fit into slot 50. In particular, as seen in FIG. 3, the diameter "d" of the C-shaped edge has the same diameter as the control rod 18 so that the control rod 18 cannot rattle with respect to the shoe, and so that the engagement between the shoe and the control rod 18 occurs only at the C-shaped edge 56 thereby providing a line of contact between the shoe and the rod rather than on a surface of contact so that the friction fit which resists sliding movement of the control rod is minimized.

It will be appreciated that upon operation of the door handle 16, the control rod 18 is shifted longitudinally as permitted by sliding of the control rod through the shoe 20. At the same time, the limited rotation of the control rod 18 which may be experienced during this sliding movement can be accommodated by the limited rotary movement of the control rod 18 within the confines of the conical walls 52 and 54, or by the slight rotation of the shoe 20 with respect to the inner trim panel 14.

Although the drawings of FIGS. 2 and 3 show that the C-shaped edge 56 is defined at the intersection of two conical converging walls, it will be appreciated that the same effect may be obtained by a single conical converging wall which reaches all the way through the body 20 so that the C-shaped edged 56 would appear at the edge of the body 30 instead of at the center of the body.

I have found that the invention can be carried out using a plastic body 20 molded of Acetal, and a control rod having a diameter of 4.1 mm.

The C-shaped edge 56 has a diameter "d"=4.1 mm (+0.1, −0.0−). The diameter "X" of the entry portion 58 of the slot 50 may be 3.5 mm (+0.1, −0.0) and the larger diameter outer end of the conical converging walls 4.8 mm (+0.1, −0.0).

The shoe is shown herein as employed to mount a control rod extending between the door handle and the door latch. It will be also understood that the shoe may be employed to mount a lock rod extending from a door lock button to the door latch.

Thus it is seen that the invention provides a new and improved shoe for rattle free mounting of a door latch control on the vehicle door.

The embodiments of the invention in which an exclusive property or privilege is claimed are defined as follows:

1. A shoe for slidably and rotatably mounting a door latch control rod on a vehicle door, comprising:
   a molded plastic body having a mounting portion adapted for attachment on the vehicle door;
   and a slot formed in the body for receiving the rod, said slot being defined by conical converging walls defining a C-shaped edge circumjacently engaging the rod in slip fitting rattle free relationship therewith so that the rod may slide through the shoe upon operation of the door latch control rod by the occupant.

2. A shoe for slidably and rotatably mounting a door latch control rod on a vehicle door, comprising:
   a molded plastic body,
   means rotatably mounting the plastic body on the vehicle door;
   and a slot formed in the body for receiving the rod, said slot being defined by conical converging walls defining a C-shaped edge circumjacently engaging the rod in slip fitting rattle free relationship therewith so that the rod may slide through the shoe upon operation of the door latch control rod by the occupant.

3. A shoe for slidably and rotatably mounting a door latch control rod on a vehicle door, comprising:
   a molded plastic body,
   means rotatably mounting the plastic body on the vehicle door;
   and a slot formed in the body for receiving the rod, said slot being defined by first and second conical converging walls projecting into the plastic body and intersecting to define a C-shaped edge circumjacently engaging the rod in slip fitting rattle free relationship therewith so that the rod may slide through the shoe upon operation of the door latch control rod by the occupant.

* * * * *